US008375951B2

(12) United States Patent
Gebrewold et al.

(10) Patent No.: US 8,375,951 B2
(45) Date of Patent: Feb. 19, 2013

(54) BUCKLE AND RESPIRATOR USING SUCH BUCKLE, HAVING A DEFORMABLE CINCH BAR, AND METHOD

(75) Inventors: Yonas Gebrewold, Woodbury, MN (US); Michael K. Domroese, Woodbury, MN (US); Dwayne D. Daugaard, Hudson, WI (US); Daniel J. Stepan, Woodbury, MN (US); Lance E. Behymer, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1259 days.

(21) Appl. No.: 12/026,874

(22) Filed: Feb. 6, 2008

(65) Prior Publication Data

US 2009/0193628 A1 Aug. 6, 2009

(51) Int. Cl.
*A61M 11/00* (2006.01)

(52) U.S. Cl. ..... 128/207.11; 128/207.17; 24/197; 24/198; 24/200

(58) Field of Classification Search ..... 128/207.11, 128/207.17, 206.21; 24/197, 198, 200
See application file for complete search history.

(56) References Cited

U.S. PATENT DOCUMENTS

| | | | | |
|---|---|---|---|---|
| 2,002,946 | A * | 5/1935 | Jacobs | 24/197 |
| 2,224,773 | A | 12/1940 | Shaulson | |
| 2,276,595 | A | 3/1942 | Shaulson | |
| 2,278,153 | A * | 3/1942 | Shaulson | 24/200 |
| 3,792,702 | A | 2/1974 | Delest | |
| 4,112,521 | A | 9/1978 | Uke | |
| 4,117,573 | A * | 10/1978 | Nakamura | 24/22 |
| 4,171,555 | A | 10/1979 | Bakker et al. | |
| 4,395,803 | A | 8/1983 | Krauss | |
| 4,400,855 | A * | 8/1983 | Stuart | 24/200 |
| 4,454,881 | A | 6/1984 | Huber et al. | |
| 4,525,901 | A | 7/1985 | Krauss | |
| 4,571,783 | A | 2/1986 | Kasai | |
| 4,790,306 | A | 12/1988 | Braun et al. | |
| 4,807,619 | A | 2/1989 | Dyrud et al. | |
| 4,843,689 | A | 7/1989 | Fildan | |
| 4,873,972 | A | 10/1989 | Magidson et al. | |
| 4,951,664 | A | 8/1990 | Niemeyer | |
| 5,062,421 | A | 11/1991 | Burns et al. | |
| 5,237,986 | A | 8/1993 | Seppala et al. | |
| 5,464,010 | A | 11/1995 | Byram | |
| 5,649,532 | A | 7/1997 | Griffiths | |
| 5,657,493 | A | 8/1997 | Ferrero et al. | |
| 5,673,690 | A | 10/1997 | Tayebi et al. | |
| 6,062,221 | A | 5/2000 | Brostrom et al. | |

(Continued)

FOREIGN PATENT DOCUMENTS

| | | | |
|---|---|---|---|
| EP | 1495785 | A1 | 1/2005 |
| EP | 2005986 | A2 | 12/2008 |

(Continued)

*Primary Examiner* — Steven Douglas
(74) *Attorney, Agent, or Firm* — Karl G. Hanson

(57) ABSTRACT

Buckle and respirators having such buckles. The buckle has a movable cinch bar allowing a strap to be inserted into and be secured by the buckle by opening the cinch bar and inserting the strap. The cinch bar then returns to a closed position and supports the strap over the cinch bar. The cinch bar may be deformable through the use of a living hinge connecting the cinch bar to the body of the buckle. The cinch bar may be split into two members, each being deformably coupled to the buckle body, perhaps with living hinges.

34 Claims, 10 Drawing Sheets

U.S. PATENT DOCUMENTS

| | | | |
|---|---|---|---|
| 6,247,210 | B1 | 6/2001 | Hamilton |
| 6,279,847 | B1 | 8/2001 | Berger |
| 6,367,091 | B1 | 4/2002 | Chiang |
| 6,715,490 | B2 | 4/2004 | Byram |
| 7,077,128 | B2 | 7/2006 | Wilson et al. |
| 7,100,249 | B2 | 9/2006 | Hurn |
| 7,155,786 | B2 | 1/2007 | Grimm |
| 7,185,653 | B2 | 3/2007 | Lee |
| 2005/0051172 | A1 | 3/2005 | Lee |
| 2005/0211251 | A1 | 9/2005 | Henderson et al. |

FOREIGN PATENT DOCUMENTS

| | | | |
|---|---|---|---|
| GB | 970611 | | 2/1962 |
| GB | 2059782 | A | 4/1981 |
| GB | 2408213 | A | 5/2005 |
| JP | 2006-102339 | | 4/2006 |
| WO | WO 99/06116 | | 2/1999 |
| WO | WO 02/05883 | A1 | 1/2002 |

* cited by examiner

BUCKLE AND RESPIRATOR USING SUCH BUCKLE, HAVING A DEFORMABLE CINCH BAR, AND METHOD

The present invention relates generally to buckles, and respirators having such buckles, having a deformable cinch bar, and, more particularly, to buckles and respirators having such buckles, facilitating strap threading, and a method therefore.

BACKGROUND

Respirators are commonly worn over the breathing passages of a person for at least one of two common purposes: (1) to prevent impurities or contaminants from entering the wearer's breathing track; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or clean room.

Some respirators are categorized as being "filtering face-pieces" because the mask body itself functions as the filtering mechanism. Unlike respirators that use rubber or elastomeric mask bodies in conjunction with attachable filter cartridges (see, e.g., U.S. Pat. No. 5,062,421 to Burns et al.) or insert-molded filter elements (see, e.g., U.S. Pat. No. 4,790,306 to Braun), filtering face-piece respirators have the filter media comprise much of the whole mask body so that there is no need for installing or replacing a filter cartridge. As such, filtering face-piece respirators are relatively light in weight and easy to use.

Various embodiments for securing the respirator to the user are known in the art. A known embodiment includes the use of buckles, secured to the respirator, with a strap that is removably secured to each of the buckles and that passes behind the user's head relative to the respirator mask. The strap may be tightened and loosened by operation of the buckle. In various known embodiments, the buckle has a slot, with a single-piece cinch bar splitting the slot into two parts. A user may secure the strap to the buckle by passing the strap through one part of the slot in one direction, and then passing the strap through the other part of the slot in the opposite direction such that the strap is held in place through friction, such as friction between the two ends of the strap.

SUMMARY

The buckles used on respirator masks that are known in the art, however, suffer from the common issue of making it comparatively difficult or finicky to secure the strap to the buckle. The strap may be threaded through one portion of a slot, turned over, threaded through the other portion, and then tightened, thereby commonly requiring at least four independent actions to secure the strap. This makes it difficult to automate assembly of the strap to the buckle during manufacture of the buckle and, hence, tends to make the buckle and respirator more expensive to manufacture and purchase.

In the event that the strap may come loose from the buckle in an environment in which it is desirable to utilize a respirator, such as in emergency situations such as fire or medical emergencies, a user may waste valuable or even life-critical time fumbling with the straps and buckles of their respirator. Even in conditions that are not potentially life threatening, such as in manufacturing clean rooms, a user's time may still be very costly, and the loss of even a few minutes to fumbling with a strap and buckle every time a respirator is donned and doffed may, over time and with a large number of people, add up to significant losses of time and efficiency.

A buckle has been developed, an embodiment of which may improve the ease of securing the strap to the buckle. The cinch is movable, such as being deformably coupled to the buckle body, such that the strap, or a loop in the strap, may be passed through an opening created by the movement of the cinch bar and secured thereon when the cinch bar moves to a closed position.

In an embodiment, instead of the cinch bar being a single piece, the cinch bar may be comprised of two pieces, portions or members, each piece, portion or member extending from an opposite side of the slot relative to the other. In various embodiments, the pieces may or may not join in the middle of the slot. The pieces of the cinch bar may move relative to each other, but without a force they may tend to be in a relaxed position. The pieces may be configured such that when a force is placed on the cinch bar in one direction, the cinch bar may move relative to the rest of the buckle, creating an opening between the two pieces, through which the strap may be passed. In various embodiments, the cinch bar may return to its relaxed position either when the force is no longer placed on the cinch bar, or when an opposite force is placed on the cinch bar. In an embodiment, the opposite force may come from tension being placed on the strap.

Thus, in the above embodiment, the act of securing the strap to the buckle may require only a single action, namely pressing the strap against the cinch bar such that the force of the pressing creates the opening in the cinch bar which allows the strap to pass through. Once the strap has passed through the opening, the force may be off the cinch bar, and the cinch bar may return to its relaxed position, securing the strap like a cinch bar known in the art. In an alternative embodiment, the cinch bar may return to the relaxed position when tension is placed on the strap. In either case, the securing of the strap to the buckle may require only one or two relatively straightforward actions, rather than three or four relatively intricate actions.

In various embodiments, the cinch bar may be able to move because the pieces of the cinch bar are connected to the rest of the buckle with living hinges. Alternatively, the pieces of the cinch bar may be connected directly to the rest of the buckle, but the material used and the thickness of the cinch bar may be such that the pieces may flex relative to the rest of the buckle, thereby allowing the cinch bar to move. An alternative embodiment of the living hinges involves the living hinges being positioned such that the cinch bar may only open when force from one direction is placed on the cinch bar, but not from another. Likewise, in the embodiment of the flexible cinch bar, the pieces of the cinch bar may be configured such that they may flex when force is placed on the cinch bar in one particular direction. In an embodiment, this may be realized by angling the pieces of the cinch bar relative to each other, such that when force is placed on the cinch bar in the opposite direction the pieces come together and cannot flex any further.

In various further embodiments, the buckles may be mounted on a respirator to secure the respirator to a user with straps. In various alternative embodiments, the buckles may be mounted on any number of other objects and devices for securing them to other users and other devices. Such devices may include personal entertainment equipment, such as personal music players, or a belt for use on pants. Other such objects may include medical or safety equipment, such as a Holter monitor or a respirator mask In an embodiment, the present invention provides a buckle having a body having a slot, and a cinch bar configured with respect to the slot. The cinch bar also has a first position supporting a strap placed thereon and a second position providing an opening sufficient to pass the strap therethrough, the cinch bar returning to the first position and supporting the strap when tension is placed thereon.

In an embodiment, the cinch bar is separated into first and second members. When the cinch bar moves to the second, open, position, the first and second members deform with respect to the buckle body creating the opening for the strap, or a loop of the strap, to pass therethrough.

In an embodiment, the first member and the second member are configured to return to the first position in response to a force from the strap when tension is placed thereon.

In an embodiment, the first member and the second member are configured to move to the second position to create the opening allowing the strap to pass therethrough in a first direction in response to a force against the cinch bar from the first direction.

In an embodiment, the buckle is configured such that the first member and the second member move from the first position to the second position in the first direction and wherein the buckle is configured such that the first member and the second member are prevented from moving from the first position in a direction opposite of the first direction.

In an embodiment, the first member and the second member interlock in the first, closed, position.

In an embodiment, the first member and the second member abut in the first position.

In an embodiment, the buckle has a major plane, wherein the first direction is substantially orthogonal to the major plane and wherein the first member and the second member in the first position abut at an oblique angle to the major plane.

In an embodiment, the buckle has a first living hinge coupled between the first member and the body, and a second living hinge coupled between the second member and the body.

In an embodiment, the first living hinge is configured with respect to the first member and the second living hinge is configured with respect to the second member such that the first member and the second member move from the first position to the second position in a first direction and wherein the buckle is configured such that the first member and the second member are prevented from moving from the first position in a direction opposite of the first direction.

In an embodiment, the present invention provides a respirator having a mask, a strap, and a buckle. The buckle has a body having a slot, the body being attached to the mask, and a cinch bar configured with respect to the slot. The cinch bar has a first position supporting the strap placed thereon and a second position providing an opening sufficient to pass the strap therethrough, the cinch bar returning to the first position and supporting the strap when tension is placed thereon.

In an embodiment, the present invention provides a method for securing a strap to a buckle having a slot and a cinch bar configured with respect to the slot having a first member and a second member, the cinch bar having a first position supporting a strap placed thereon and a second position providing an opening between the first member and the second member sufficient to pass the strap therethrough, the first member and the second member returning to the first position and supporting the strap when tension is placed thereon. The method includes the steps of moving the cinch bar to the second position, placing a portion of the strap through the opening, and returning the cinch bar to the first position.

DRAWINGS

Figure 9A:
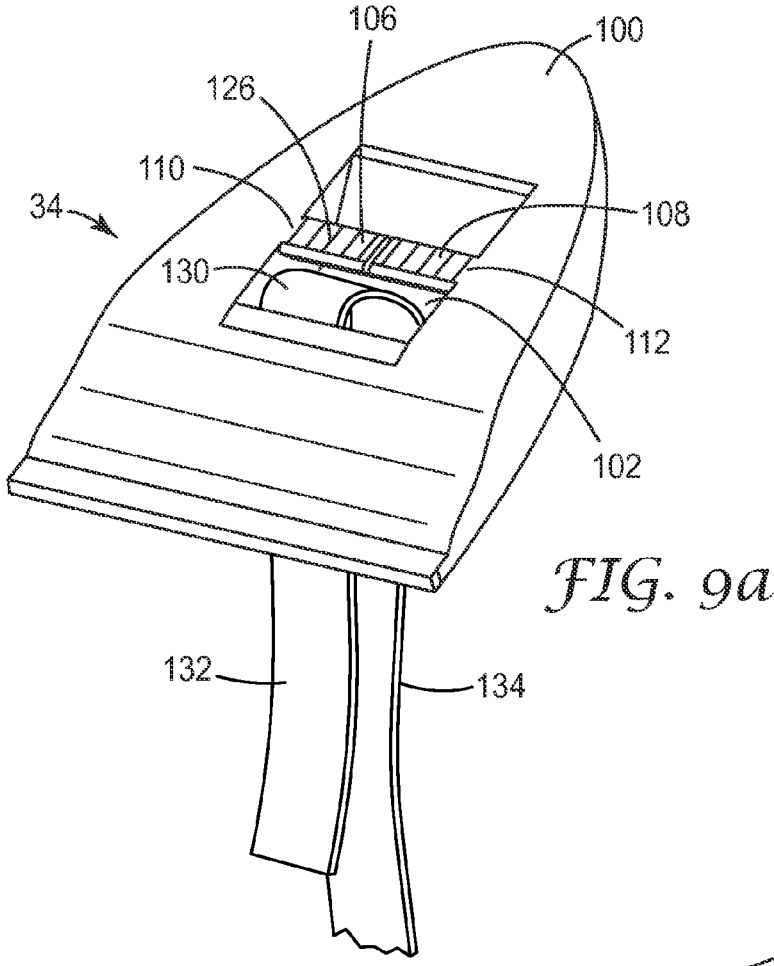
Figure 9B:
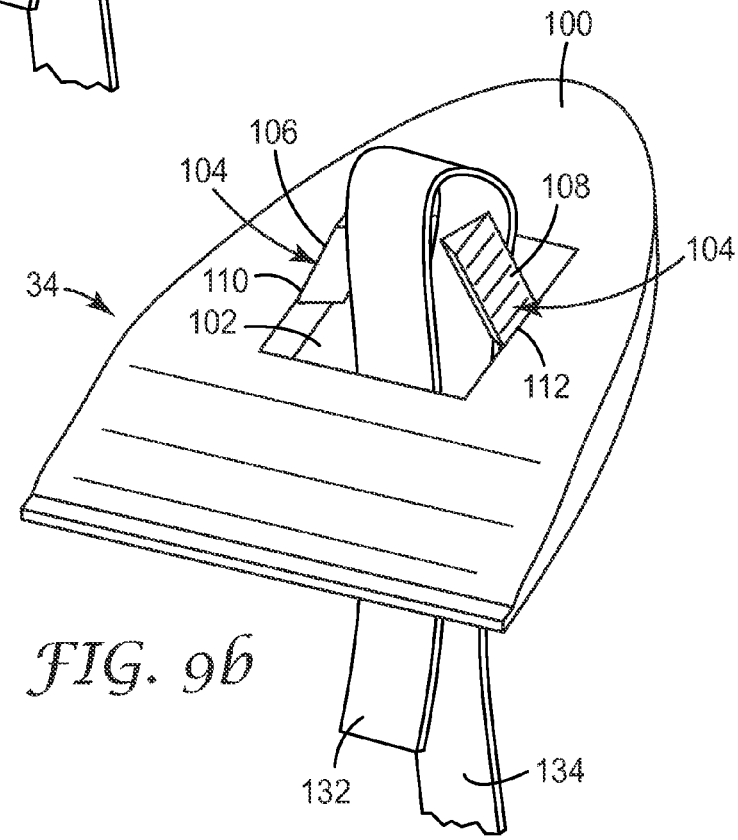
Figure 9C:
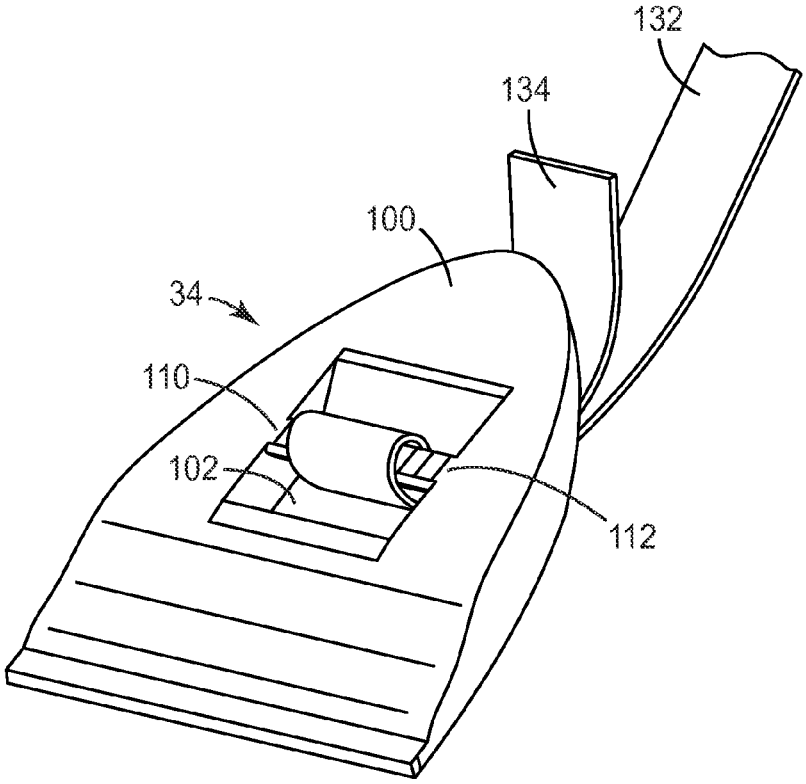
Figure 10:
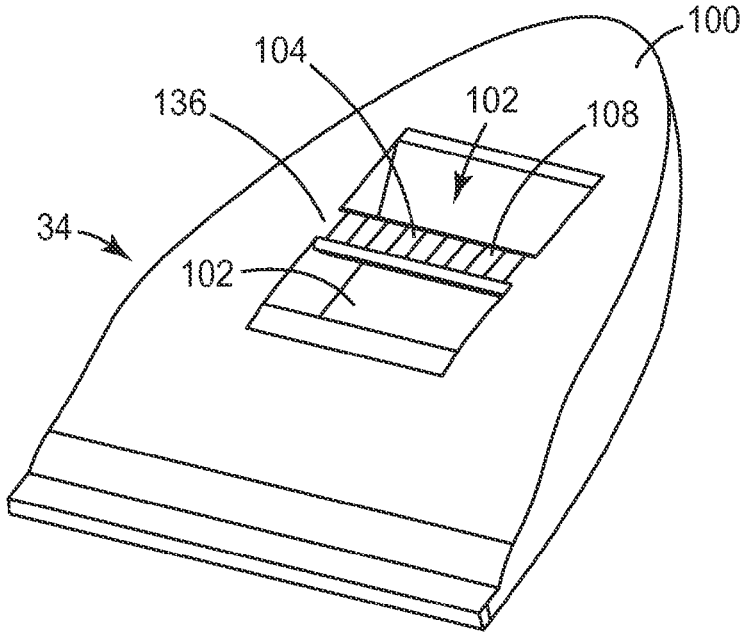
Figure 11:
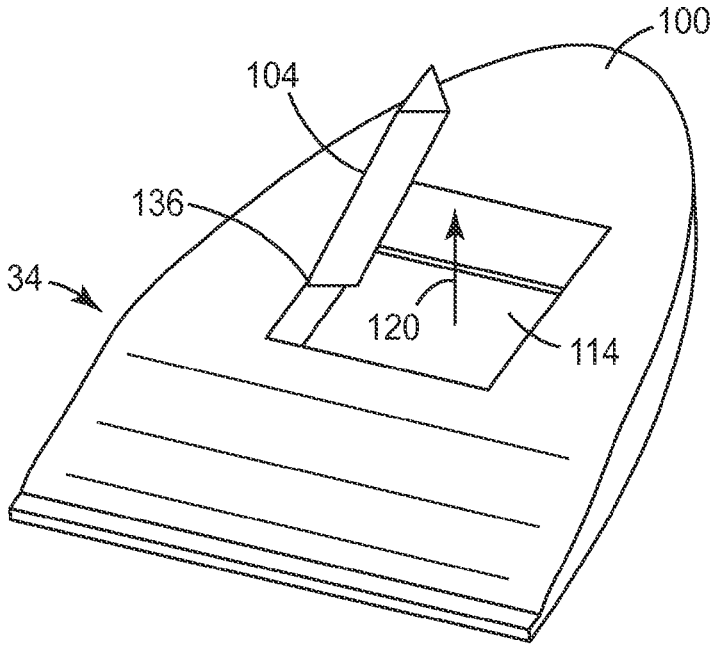
Figure 12:
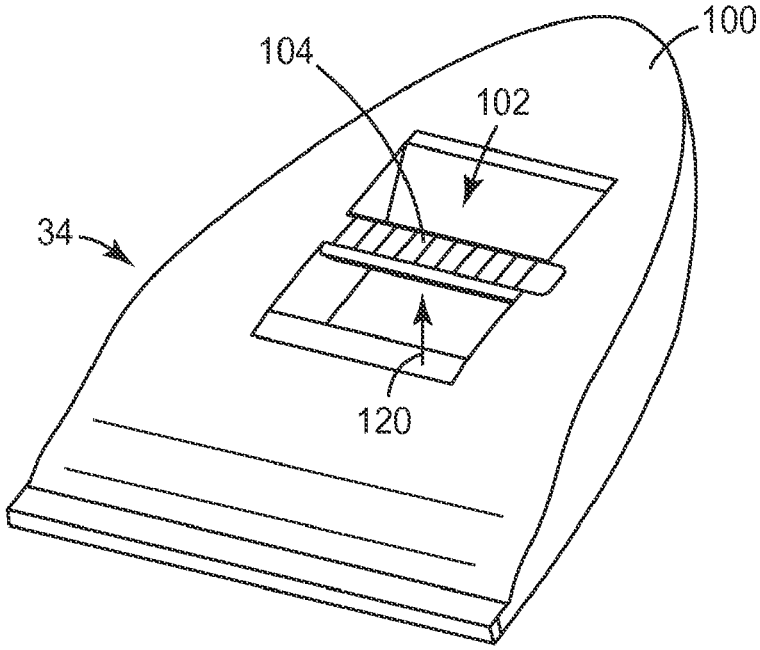
Figure 13:
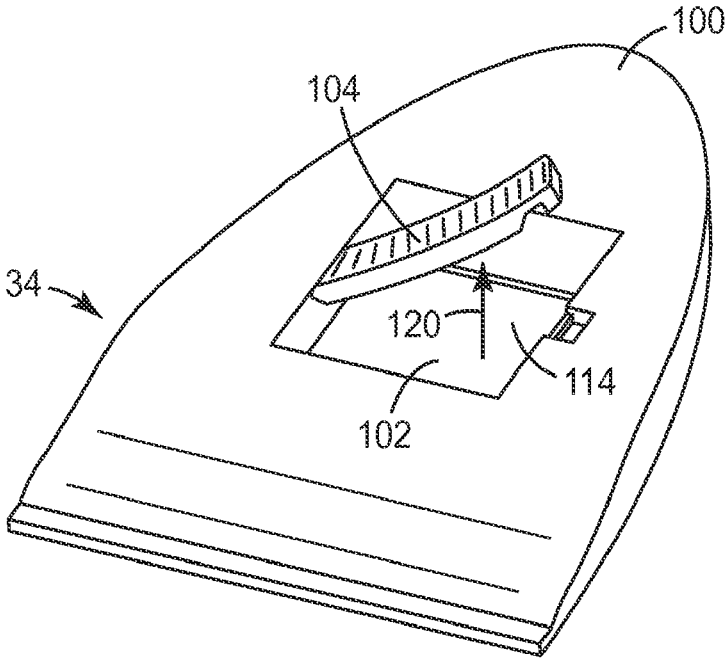
Figure 14:
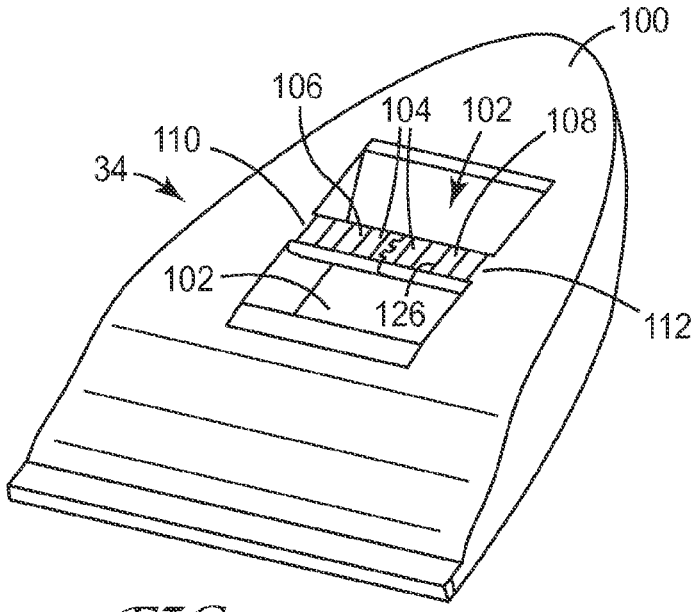
Figure 15:
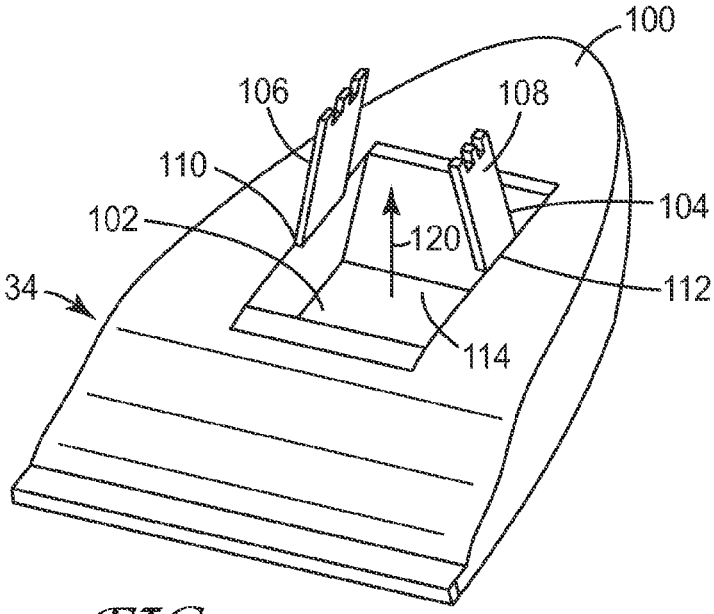
Figure 16:
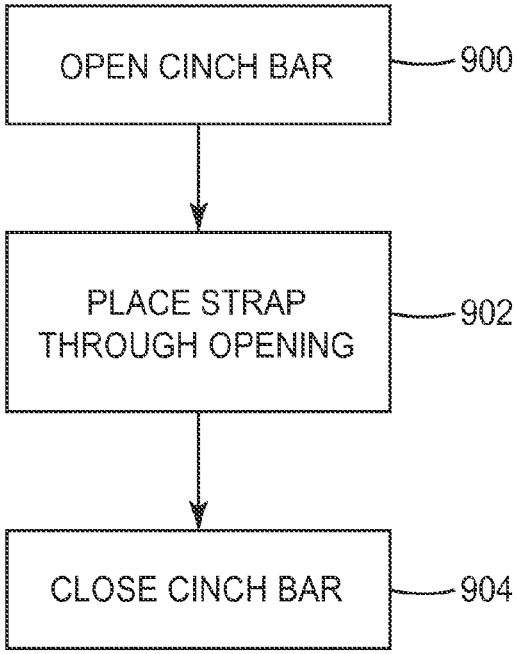

FIG. 9*a* illustrates a first step of threading a strap through the buckle with the cinch bar in the first, closed, position;

FIG. 9*b* illustrates a second step of threading a strap through the buckle with the cinch in the second, open, position with the strap having passed therethrough;

FIG. 9*c* illustrates a third step of threading a strap through the buckle with the cinch bar having returned to the first, closed, position, supporting the strap thereon;

FIG. 10 shows an alternative embodiment of a buckle having a hinged single piece cinch bar in a relaxed, closed position;

FIG. 11 shows the alternative embodiment of FIG. 10 of the buckle having a hinged single piece cinch bar in an open position;

FIG. 12 shows an alternative embodiment of a buckle having a flexible single piece cinch bar in a relaxed, closed position;

FIG. 13 shows the alternative embodiment of FIG. 12 of the buckle having flexible single piece cinch bar in an open position;

FIG. 14 shows an alternative embodiment of a buckle having a split interlocking cinch bar in a relaxed, closed position;

FIG. 15 shows the alternative embodiment of FIG. 14 of the buckle having split interlocking cinch bar in an open position;

FIG. 16 is a flow chart for using a buckle having a split cinch bar for securing a strap.

GLOSSARY

Figure 1:
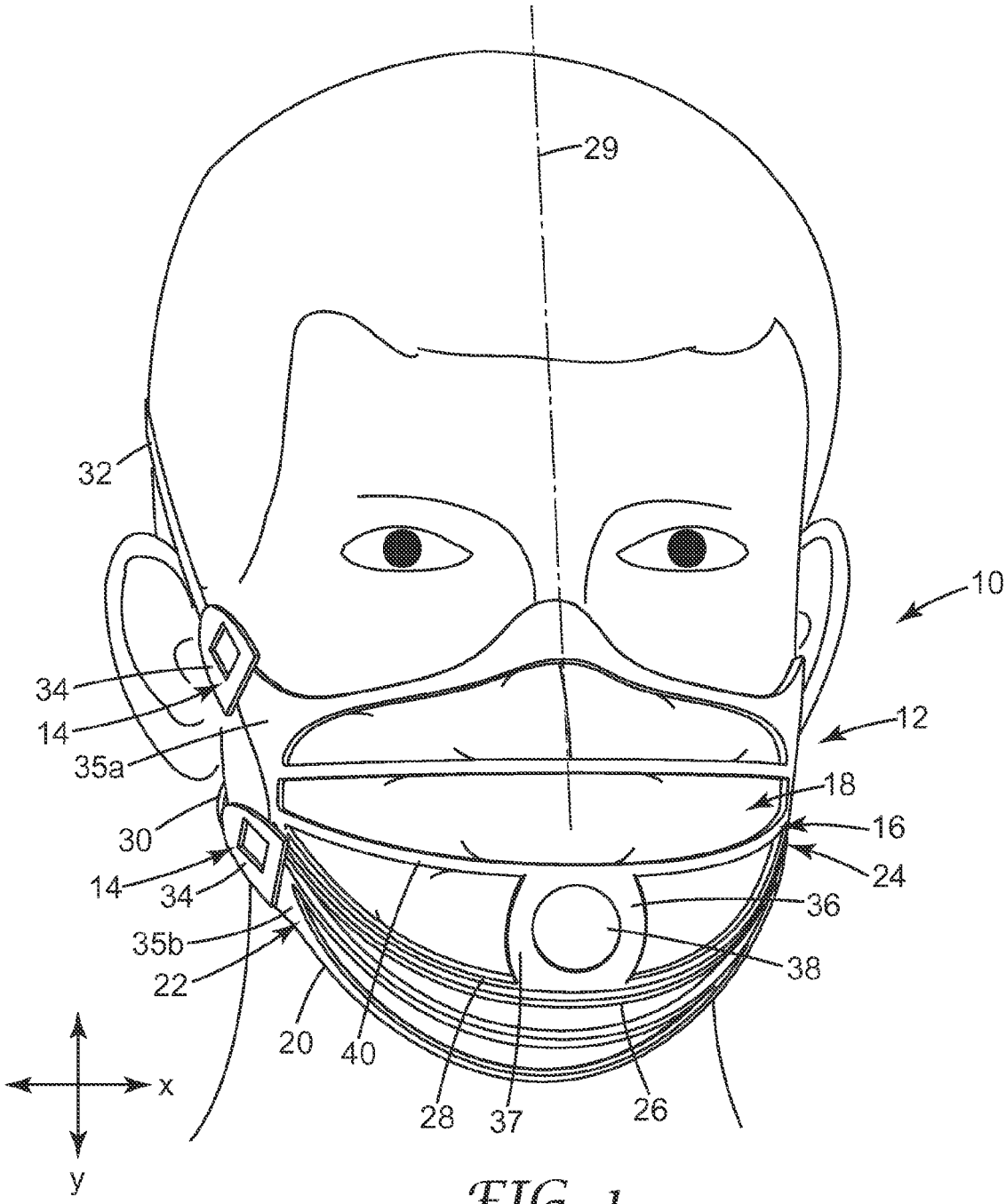
FIG. 1 shows an example of a respirator with buckles with flexural members positioned over a user's mouth and nose.

The terms set forth below will have the meanings as defined:

"bisect(s)" means to divide into two generally equal parts;

"centerline" means a line that bisects the mask vertically when viewed from the front (FIG. 1);

"centrally spaced" means separated from one another along a line or plane that bisects the mask body vertically when viewed from the front;

"comprises (or comprising)" means its definition as is standard in patent terminology, being an open-ended term that is generally synonymous with "includes", "having", or "containing". Although "comprises", "includes", "having", and "containing" and variations thereof are commonly-used, open-ended terms, this invention also may be suitably described using narrower terms such as "consists essentially of", which is semi open-ended term in that it excludes only those things or elements that would have a deleterious effect on the performance of the inventive respirator in serving its intended function;

"contaminants" means particles (including dusts, mists, and fumes) and/or other substances that generally may not be considered to be particles (e.g., organic vapors, et cetera) but which may be suspended in air, including air in an exhale flow stream;

"crosswise dimension" is the dimension that extends laterally across the respirator from side-to-side when the respirator is viewed from the front;

"exterior gas space" means the ambient atmospheric gas space into which exhaled gas enters after passing through and beyond the mask body and/or exhalation valve;

"filtering face-piece" means that the mask body itself is designed to filter air that passes through it; there are no separately identifiable filter cartridges or inserted-molded filter elements attached to or molded into the mask body to achieve this purpose;

"filter" or "filtration layer" means one or more layers of air-permeable material, which layer(s) is adapted for the primary purpose of removing contaminants (such as particles) from an air stream that passes through it;

"filtering structure" means a construction that is designed primarily for filtering air;

"first side" means an area of the mask body that is laterally distanced from a plane that bisects the respirator vertically and that would reside in the region of a wearer's cheek and/or jaw when the respirator is being donned;

"flexural member" means a member that is capable of being substantially flexed or bent;

"harness" means a structure or combination of parts that assists in supporting the mask body on a wearer's face;

"hinder movement" means impede, restrict, or deprive of movement when exposed to forces that exist under normal use conditions;

"interior gas space" means the space between a mask body and a person's face;

"living hinge" means a mechanism that allows members that extend therefrom to generally pivot thereabout in a rotational-type manner with such ease that damage is not caused to the members or to the hinge joint;

"longitudinally-movable" and "move longitudinally" means capable of being moved in the longitudinal direction in response to mere finger pressure;

"mask body" means an air-permeable structure that is designed to fit over the nose and mouth of a person and that helps define an interior gas space separated from an exterior gas space;

"member", in relation to the support structure, means an individually and readily identifiable solid part that is sized to contribute significantly to the overall construction and configuration of the support structure;

"perimeter" means the outer edge of the mask body, which outer edge would be disposed generally proximate to a wearer's face when the respirator is being donned by a person;

"pleat" means a portion that is designed to be folded back upon itself,

"pleated" means being folded back upon itself,

"plastic" means a material that mainly includes one or more polymers and may contain other ingredients as well;

"plurality" means two or more;

"respirator" means an air filtration device that is worn by a person to provide the wearer with clean air to breathe;

"second side" means an area of the mask body that is distanced from a plane line that bisects the mask vertically (the second side being opposite the first side) and that would reside in the region of a wearer's cheek and/or jaw when the respirator is being donned;

"support structure" means a construction that is designed to have sufficient structural integrity to retain its desired shape, and to help retain the intended shape of the filtering structure that is supported by it, under normal handling;

"spaced" means physically separated or having measurable distance therebetween;

"transversely extending" means extending generally in the crosswise dimension.

DESCRIPTION

In order to facilitate securing a strap to a buckle, it is desirable to provide a buckle that allows for securing the strap to the buckle with relatively few actions by a user. A buckle that requires few actions to secure a strap may improve efficiency in manufacture and efficiency in threading the buckle in use of a respirator and, in dangerous situations, may prevent injury and save lives. In an embodiment, a buckle has been developed with a deformably separable cinch bar that allows for an opening to be created allowing a strap to slip through. The opening may be created by placing force on the cinch bar, and once the strap has passed through, the opening may close either by placing an opposite force on the cinch bar or the cinch bar may inherently result in the opening being closed. In an embodiment, the cinch bar may be connected to the rest of the buckle with living hinges. In an alternative embodiment, the cinch bar may be connected directly with the rest of the buckle, but may be made of a material and of a thickness that allows the cinch bar to flex.

In an embodiment, the buckles may be used with a respirator. The buckles may facilitate faster and more convenient donning and doffing of the respirator, there by saving time. The buckles may also be used in many other applications in which buckles are commonly used, particularly in the securing of an object to another object or body. Such applications may range from those of medical professionals and emergency responders in critical situations, who may need to secure various pieces of equipment to themselves very quickly, to common, more pedestrian applications.

FIG. 1 shows a respirator 10 that is being worn over the nose and mouth of a person. The respirator 10 includes a mask body 12 and a harness 14. The mask body 12 has a support structure 16 and a filtering structure 18. The support structure 16 includes a perimeter 20, a first side 22, and an opposing second side 24. The perimeter 20 of the support structure 16 may, but not necessarily, contact the wearer's face when the respirator 10 is being donned. The perimeter 20 may comprise a member, or combination of members, that extend 360 degrees continuously about, and adjacent to, the periphery of the mask body 12. Typically, the wearer's face will contact only the inner surface or periphery of the filtering structure 18 (or an additional face seal material) so that a comfortable fit is achieved. Thus, the peripheral edge of the filtering structure 18 may extend slightly beyond the perimeter 20 of the support structure 16.

The support structure 16 also includes a longitudinally-movable, transversely-extending member 26. This longitudinally-movable, transversely-extending member 26 extends from a first side 22 of the mask body 12 to a second side 24 without being joined together between sides 22 and 24 by any longitudinally-extending member(s) that could hinder movement of the transversely-extending members 26 in a longitudinal direction. That is, there is no structural member that joins member 26 to member 28 so as to restrict member 26 from moving away from member 28 when the wearer expands their jaw or opens their mouth. The longitudinal movement that is beneficially achieved according to the illustrated embodiment is particularly pronounced along the center line 29. Transversely-extending members 26, 28 converge towards each other moving from centerline 29 to each side 22, 24 of the support structure 16. When viewing the respirator as projected onto a plane from the front, the transverse dimension extends across the respirator in the general "x" dimension, and the longitudinal dimension that extends between the bottom and top of the respirator 10 in the general "y" dimension. When viewed through such a planar projection, the transversely-extending member 26 can move towards and away from member 28 in the general "y" direction. In so doing, the member 26 moves towards and away from member 28 a greater distance along the center line 29 than at the first and second sides 22 and 24 where the transversely-extending members merge together.

The harness 14 includes first and second straps 30 and 32 that may be adjusted in length by one or more buckles 34. The harness 14 may be secured to the mask body 12 at the first and second sides 22, 24 at harness-securement flange members 35*a*, 35*b*. The buckles 34 may be secured to the mask body 12 at flange members 35*a*, 35*b* by a variety of methods, including stapling, adhesive bonding, welding, and the like. The buckles also may be integrally molded into the support structure 16. The mask body 12 also includes an optional frame 36 that has an opening 38 located therein. The frame 36 provides a location or foundation for securing an exhalation valve (not shown) to the mask body 12. Although the transversely-extending members 28 and 40 are joined together by longitudinally extending members 37 on the frame 36, the mask body 12 nonetheless may be expanded by relatively free movement between members 26 and 28 and other members that are not so joined relative to one another. Thus, although the invention contemplates having one or more members (2, 3, 4, 5, etc.) that exhibit the capacity to move longitudinally toward or away from each other, not all transversely extending members need to demonstrate such behavior with respect to each adjacent member to accomplish objectives in accordance with the present invention.

Figure 2:
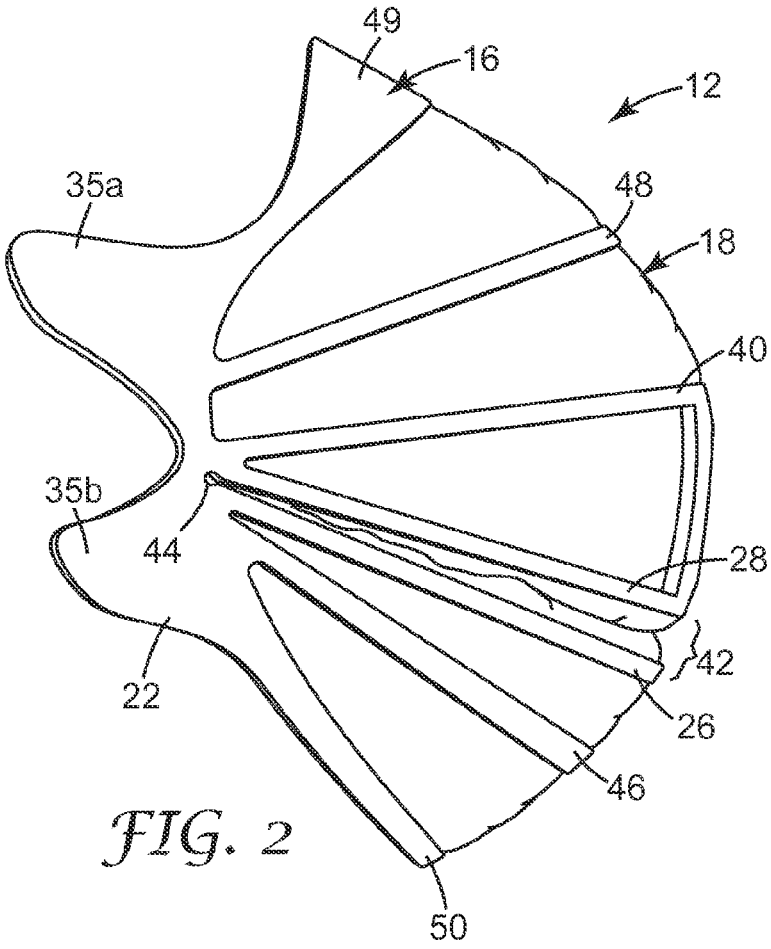
FIG. 2 shows a side view of the respirator of FIG. 1.

FIG. 2 illustrates a side view of the mask body 12 where transversely-extending members 26 and 28 are positioned adjacent to one another such that the filtering structure 18 becomes pleated therebetween in pleatable region 42. The support structure 16 of mask body 12 may further include a living hinge 44 located in the region where movable transversely extending member 26 meets member 28. The living hinge 44 is beneficial in that it allows transversely-extending members 26 and 28 to more easily move towards one another or to move apart from one another. In an embodiment, living hinge 44 has a cul-de-sac shape.

In a further embodiment, living hinge 44 also is disposed between upper and lower harness attachment flanges 35*a* and 35*b* in the "y" dimension when the mask 12 is oriented in an upright configuration as shown in FIG. 2. In an embodiment, there are one, two, three, or more living hinges disposed between the point where the harness 14 (FIG. 1) exerts its force on the mask body (in this instance at flanges 35*a* and 35*b*). As shown in FIG. 2, there are other transversely-extending members 46, 48, 49, and 50 that do not have longitudinally-extending members located therebetween away from each side 22 or 24. Thus, while transversely-extending members 40 and 48, for example, may be able to move in a longitudinal dimension to allow the mask body 12 to expand or contract, these members may not be as freely movable as member 26 because the former lacks a cul-de-sac-shaped living hinge where they come together at the first and second side portions 22 and 24. It is to be recognized and understood that there are a variety of well known living hinge geometries that could be utilized other than a cul-de-sac. The lack of a pleat in the filtering structure between two members may also limit the longitudinal travel of the members. Therefore, although only one such living hinge 44 is illustrated at each end of the transversely-extending members 26, 28, 46, 48, 49 and 50, the present invention does indeed contemplate using such additional living hinges between additional transversely-extending members. The living hinges may be used where the transversely-extending members meet. There should not, however, be any longitudinally-extending members located between members that are intended to move longitudinally toward or away from one another. As shown, each of the transversely-extending members 26, 28, 40, 46, 48, 49, and 50 converge towards each other in the direction moving away from the centerline 29 toward each of the sides 22, 24. At each side, the transversely-extending members within the perimeter (i.e. members 26, 28, 40, 46, and 48) may converge towards each other such that all the members are within 35 mm or less from each other when viewed from the side; whereas, the same members may be centrally spaced a total of about 50 to 100 mm at the centerline 29 (FIG. 1).

Figure 3:
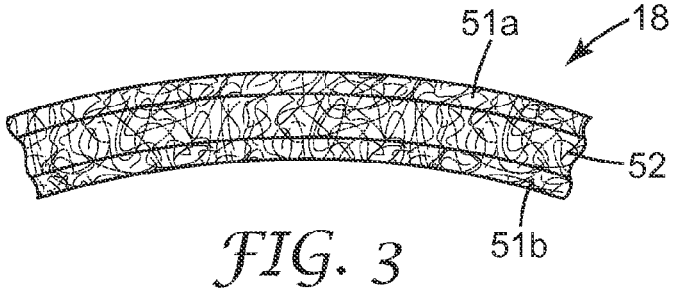
FIG. 3 shows a view of filtering structure of the respirator of FIG. 1.

FIG. 3 shows a cross-section of the filtering structure 18. As illustrated, the filtering structure 18 may include one or more cover webs 51*a* and 51*b* and a filtration layer 52. The cover webs 51*a* and 51*b* may be located on opposing sides of the filtration layer 52 to capture any fibers that could come loose therefrom. Typically, the cover webs 51*a* and 51*b* are made from a selection of fibers that provide a comfortable feel, particularly on the side of the filtering structure 18 that makes contact with the wearer's face. The construction of various filter layers and cover webs that may be used in conjunction with the support structure of the present invention are described below in more detail.

Figure 4:
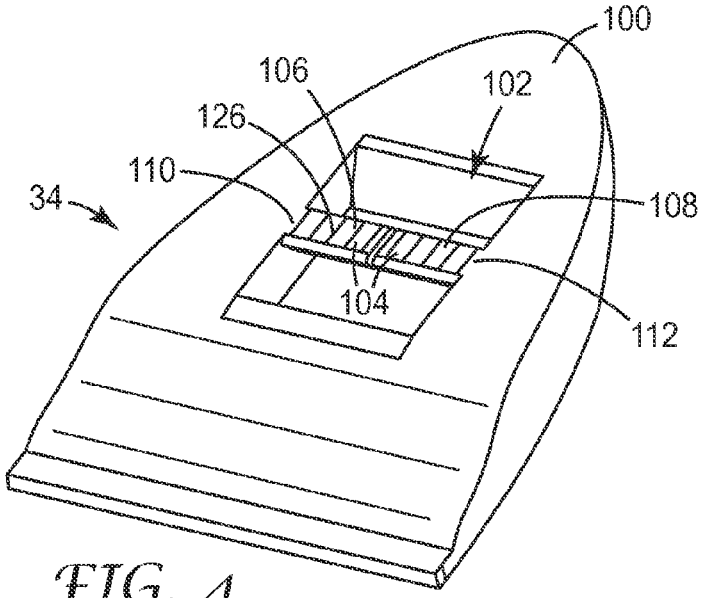
FIG. 4 shows a view of a buckle having living hinges in a relaxed position.
Figure 5:
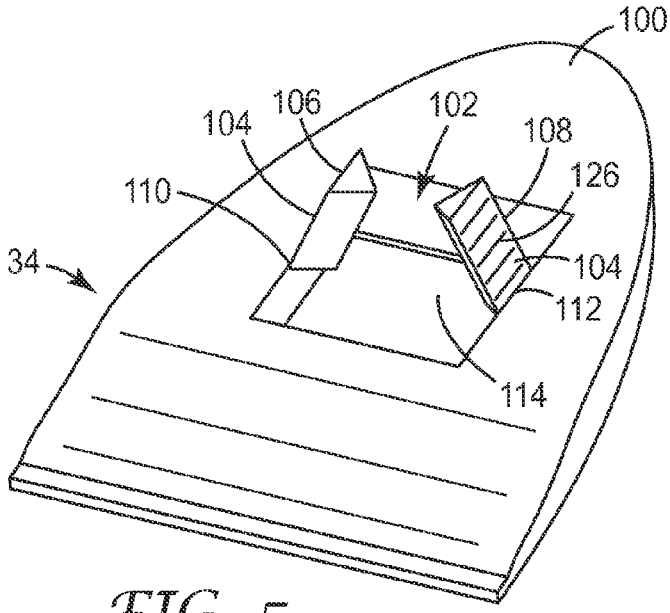
FIG. 5 shows a view of a buckle having living hinges in an open position.
Figure 6:
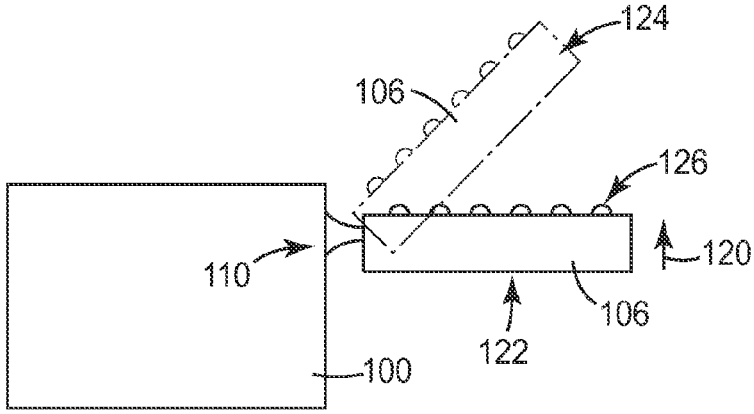
FIG. 6 shows a close view of the living hinges of the buckle of FIGS. 4 and 5.

FIGS. 4-6 show an embodiment of buckle 34 utilizing a living hinge 110, 112. FIG. 4 shows an embodiment of buckle 34 having body 100, slot 102 and cinch bar 104. Body 100 may be operatively coupled to flange members 35*a*, 35*b* of mask body 12. In alternative embodiments, flange members 35*a*, 35*b* may not be a component of mask body 12 and body 100 may be operatively coupled to mask body 12 generally. In various embodiments, body 100 is operatively coupled to flange members 35*a*, 35*b* with a staple, adhesive or any suitable means of securing body 100 to flange members 35*a*, 35*b* known in the art.

In the illustrated embodiment, cinch bar 104 is comprised of a first member or first portion 106 and a second member or second portion 108. Each first portion 106 and second portion 108 is connected to body 100 with a hinge 110, 112. Hinges 110, 112 allow portions 106, 108 to move or rotate. In an embodiment, hinges 110, 112 are living hinges. As illustrated in FIG. 4, portions 106, 108 are not rotated, and cinch bar 104 is in a first, relaxed position. Portions 106, 108 may move or rotate upon a force being placed on one or both of portions 106, 108. With cinch bar 104 in a relaxed position, where strap 30, 32 is positioned such that strap 30, 32 passes through one side of slot 102, over cinch bar 104 and then back down the other side of slot 102, cinch bar 104 may provide friction on strap 30, 32 such that strap 30, 32 is difficult to move with respect to cinch bar 104. In various embodiments, cinch bar 104 may have ridges 126 or other forms that vary the surface area and frictional coefficient of cinch bar 104 relative to straps 30, 32, thereby increasing or decreasing the amount of friction cinch bar 104 imposes on straps 30, 32. In an embodiment, portions 106, 108 do not come into close contact with each other, but instead are separated by a comparatively small distance sufficiently small to prevent strap 30, 32 from passing through.

In an embodiment, buckle body 100 is approximately 27.6 millimeters in length and approximately 19.6 millimeters in width. Slot 102 has a width, i.e., transverse buckle body 100, of approximately 8.6 millimeters and a length, i.e., along the length of buckle body 100, of approximately 8.4 millimeters. Buckle body 100 has a height of approximately 2.7 millimeters.

FIG. 5 shows another view of the embodiment of buckle 34 shown in FIG. 4, with cinch bar 104 in a second, moved position. Portions 106, 108 have rotated on hinges 110, 112, creating opening 114. Cinch bar 104 may be considered to be in the moved position when opening 114 is sufficiently large to allow strap 30, 32 to pass through. With cinch bar 104 in the moved position, strap 30, 32 may pass through opening 114. As an example, a loop may be formed in strap 30, 32 and the end of the loop of strap 30, 32 may be passed through opening 114 in a first direction. Once strap 30, 32 has passed through opening 114, cinch bar 104 may return to the relaxed position of FIG. 4 in order to support strap 30, 32. As strap 30, 32 relaxes onto cinch bar 104 or when tension is placed on strap 30, 32 against cinch bar 104, strap 30, 32 passes through opening 102 on both sides of cinch bar 104 with the end of the loop formed with strap 30, 32 being supported by cinch bar 104 preventing the loop of strap 30, 32 from being pulled back down through slot 102 in a direction opposite of the first direction.

Portions 106, 108 of cinch bar 104 generally flex upward with respect to buckle body 100 to create opening 114. In an embodiment, portions 106 and/or 108 generally flex upward generally maintaining a movement generally aligned with a planar surface of portions 106 and/or 108. It is to be recognized and understood in some embodiments that such an alignment is not required. Portions 106 and/or 108 may twist or bend or flex in a manner that is not so aligned.

FIG. 6 shows a close-up view of living hinge 110 connecting body 100 to portion 106. In an embodiment, living hinge 110 is positioned relative to body 100 and portion 106 such that while portion 106 may rotate in one direction 120 to its open position 124 relative to its relaxed position 122, it may not move opposite direction 120 relative to relaxed position 122. This allows for cinch bar 104 to move and create opening 114, and then support strap 30, 32 by not then swinging in the opposite direction. In an embodiment, living hinge 110 is positioned in proximity of the major surface of portion 106 that has ridges 126 as in FIG. 4.

Figure 7:
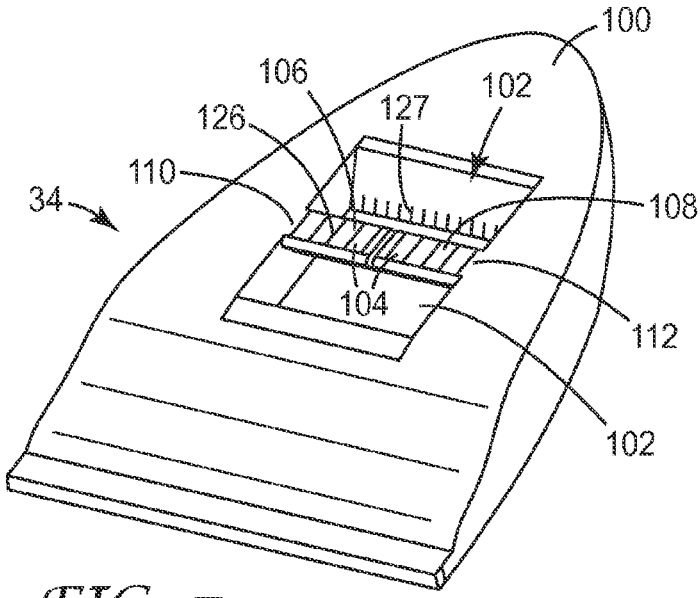
FIG. 7 shows a view of a buckle having a flexible split cinch bar in a relaxed, closed position.
Figure 8:
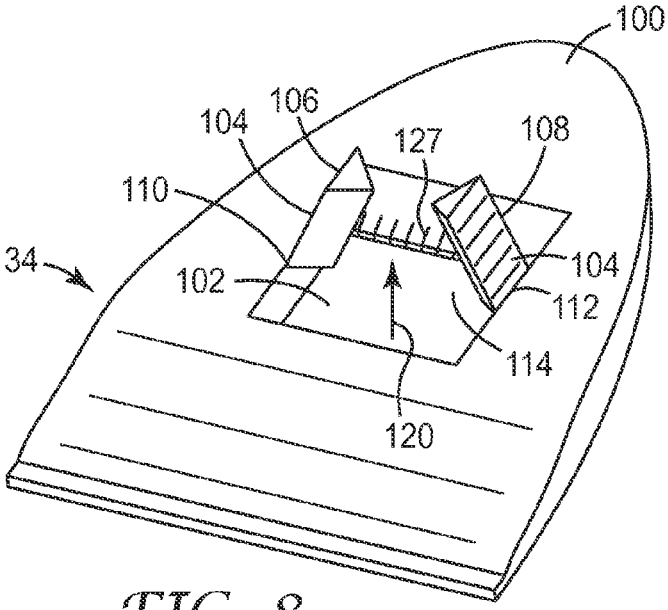
FIG. 8 shows a view of a buckle having a flexible split cinch bar in an open position.

FIGS. 7-8 illustrate an embodiment of buckle 34 with flexible portions 106, 108. FIG. 7 shows buckle 34, which comprises body 100, slot 102 and cinch bar 104. Body 100 may be operatively coupled to flange members 35*a*, 35*b* of mask body 12. In alternative embodiments, flange members 35*a*, 35*b* may not be a component of mask body 12, and body 100 may be operatively coupled to mask body 12 generally. In various embodiments, body 100 is operatively coupled to flange members 35*a*, 35*b* with a staple, adhesive, or any suitable means of securing body 100 to flange members 35*a*, 35*b* known in the art.

In the illustrated embodiment, cinch bar 104 is comprised of a first portion 106 and a second portion 108. Each first portion 106 and second portion 108 is connected to body 100. As illustrated in FIG. 7, portions 106, 108 of cinch bar 104 are in a first, relaxed position.

FIG. 8 shows a view of the embodiment of buckle 34 shown in FIG. 7, with cinch bar 104 in a second, moved position. Portions 106, 108 may move or rotate upon a force being placed on one or both of portions 106, 108. Portions 106, 108 of cinch bar 104 have flexed in first direction 120, creating opening 114. With cinch bar 104 in the moved position, strap 30, 32 may pass through opening 114. Cinch bar 104 may be considered to be in the moved position when opening 114 is sufficiently large to allow strap 30, 32 to pass through. As an example, a loop may be formed in strap 30, 32 and the end of the loop of strap 30, 32 may be passed through opening 114 in a first direction.

Once strap 30, 32 has passed through opening 114, cinch bar 104 may return to the relaxed position of FIG. 7 in order to support strap 30, 32. As strap 30, 32 relaxes onto cinch bar 104 or when tension is placed on strap 30, 32 against cinch bar 104, strap 30, 32 passes through slot 102 on both sides of cinch bar 104 with the end of the loop formed with strap 30, 32 being supported by cinch bar 104 preventing the loop of strap 30, 32 from being pulled back down through slot 102 in a direction opposite of the first direction.

With cinch bar 104 in such a relaxed position, strap 30, 32 is positioned such that strap 30, 32 passes through one side of slot 102, over cinch bar 104 and then back down the other side of slot 102, cinch bar 104 may provide friction on strap 30, 32 such that strap 30, 32 may not move with respect to cinch bar 104. In various embodiments, cinch bar 104 may have ridges 126 or other forms that vary the surface area and frictional coefficient of cinch bar 104 relative to straps 30, 32. In addition, ridges 127 or other forms that vary the surface area or friction coefficient on the back edge of slot 102 may tend to increase friction on the free end of strap 30, 32 where strap 30, 32 is squeezed against buckle body 100 by the fixed end of strap 30, 32. In an embodiment, portions 106, 108 do not come into close contact with each other, but instead are separated by a comparatively small distance sufficiently small to prevent strap 30, 32 from passing through. In an embodiment, the gap distance between portions, or members, 106 and 108 is approximately 0.4 millimeters. In an alternative embodiment, portions 106, 108 do come into physical contact with each other.

In an embodiment, members or portions 106, 108, while freely flexing to a second, or moved, position in first direction 120, are substantially prevented from flexing or moving below the major plane of buckle 34, e.g., by living hinges 110, 112 being one-way living hinges or by members 106, 108 contacting each other in the first position. In either example, members 106, 108 can not substantially deflect from their relaxed position in a direction opposite to first direction 120.

The process of threading strap 30, 32 into buckle 34 is illustrated in FIGS. 9*a*, 9*b* and 9*c*.

In FIG. 9*a*, a loop 130 in strap 30, 32, is represented here by fixed end 132 and free end 134. Fixed end 132 is the portion of strap 30, 32 that passes behind the head of the wearer and may be fixedly attached to the other side of mask body 12 or may be the fixed end of strap 30, 32 as it is threaded into a, possibly like, buckle. Free end 134 is the end of strap 30, 32 which terminates and is available to the wearer to adjust the tension of strap 30, 32 by either loosening or tightening strap 30, 32 in buckle 34.

Loop 130 is inserted or threaded into buckle 34 by passing loop 130 up into slot 102 and through opening 114 with cinch bar 104 in the second, or opened, position as shown in FIG. 9*b*. In an embodiment, cinch bar 104 is moved into the second position by the force of loop 130 pressing against cinch bar 104 from below. In an embodiment, a tool (not shown) consisting of a dual-pronged instrument may be used to push against strap 30, 32 forming loop 130 and pushing loop 130 against cinch bar 104 which may force cinch bar 104 from the first, closed, position to the second, open, position. With loop 130 passed or threaded through opening 114, cinch bar 104 is either free to return to the first, closed, position or tension, which may be slight, may be placed on strap 30, 32 putting tension on cinch bar 104 and pulling cinch bar 104 into the second, closed, position.

As shown in FIG. 9*c*, with cinch bar 104 in the second, closed, position, loop 130 of strap 30, 32 is supported around cinch bar 104. Free end 134 exits buckle 34 on top of, or between buckle body 100 and fixed end 132. With free end 134 essentially captured between buckle body 100 and fixed 132, friction keeps free end 134 from being pulled out of buckle 34 as tension is applied on free end 134 forming mask body 12 against the wearer's body. The end of buckle 34 facing toward free end 134 and fixed end 132 may be lifted by the wearer to substantially release the friction holding free end 134 in place and allowing the tension in strap 30, 32 to be at least partially released freeing the tension of mask body 12 against the wearer's body.

Cinch bar 104 may have ridges to increase the friction applied to free end 134. In an embodiment, ridges may also be provided to the back edge of slot 102 also to increase the friction provided to free end 134.

FIGS. 10 and 11 illustrate an alternative embodiment in which cinch bar 104 is made from a single piece and is hinged with respect to buckle body 100 from a single side as opposed to the split, multiple member cinch bar 104 illustrated with respect to FIGS. 4 and 5. In FIGS. 10 and 11, cinch bar 104 is positioned within buckle body 100 and operates similarly to cinch bar 104 illustrated in FIGS. 4 and 5 except that cinch bar 104 in FIGS. 10 and 11 operates as a single unit and hinges only from one side via living hinge 136 creating opening 114 to allow strap 30, 32 to pass therethrough.

FIGS. 12 and 13 illustrate another alternative embodiment in which cinch bar 104 is made from a single piece and is deformable with respect to buckle body 100 from a single side as opposed to the split, multiple member cinch bar 104 illustrated with respect to FIGS. 7 and 8. In FIGS. 12 and 13, cinch bar 104 is positioned within buckle body 100 and operates similarly to cinch bar 104 illustrated in FIGS. 7 and 8 except that cinch bar 104 in FIGS. 12 and 13 operates as a single unit and flexes only from one side via living hinge 136 creating opening 114 to allow strap 30, 32 to pass therethrough.

FIGS. 14 and 15 illustrate an alternative embodiment in which cinch bar 104 is formed of first member 106 and 108 as in FIGS. 7 and 8 except that first member 106 and second member 108 have edges which interlock with each other when cinch bar 104 is in the second, closed, position. First member 106 and second member 108 may interlock when tension is placed thereon from strap 30, 32, for example, when strap 30, 32 forces cinch bar 104 into the second, closed, position.

It is to be recognized and understood that while cinch bar 104 has been illustrated as having either one member hinged on one side or two members hinged at the sides forming an opening in the middle, that other configurations are envisioned utilizing different numbers of members, e.g., more than two members, that are hinged and/or deformable with respect to buckle body 100 are envisioned.

It is also to be recognized and understood that while cinch bar 104 has been illustrated as being deformable with respect to buckle body 100 by a living hinge or living hinges that other configurations are envisioned in which cinch bar 104, in one, two or more pieces, somehow deflect, perhaps bend, with respect to buckle body to allow strap 30, 32, or loop 130, to pass therethrough.

It is also to be recognized and understood that while cinch bar 104 has been illustrated and described as starting in a first, closed, position, moving to a second, open, position and then returning the first, closed, position, that it is not necessary that cinch bar 104 return exactly to the first position. Cinch bar 104 need only move to a position which will support strap 30, 32, or loop 130, when tension is placed thereon.

FIG. 16 is a flow chart for securing a strap 30, 32 to buckle 34. Portions 106, 108 of cinch bar 104 are moved, creating opening 114 (900). In an embodiment, opening 114 is created by a user pressing strap 30, 32 against cinch bar 104 in direction 120 using user's fingers. In various alternative embodiments, a user may utilize various acceptable implements to press against or pull cinch bar 104 in direction 120. Such implements may include any common pointed object such as a pen, or an object that may be custom designed for use with buckle 34. Once opening 114 has been created a portion of strap 30, 32 is inserted (902) into slot 102 such that a loop of strap 30, 32 is above cinch bar 104, and so that when cinch bar 104 is closed a portion of strap 30, 32 remains above cinch bar 104 relative to the rest of strap 30, 32. In an embodiment, the act of pushing strap 30, 32 against cinch bar 104 in order to create opening 114 as in opening cinch bar step (900) may be part of the same action as the insertion of strap 30, 32 into opening as in inserting strap step (902).

Once strap 30, 32 has been inserted into slot 102 through opening 114, opening 114 in cinch bar 104 is closed (904). In an embodiment, where the buckle 34 as in FIGS. 7-9 is being utilized, cinch bar 104 may close simply by withdrawing whatever was used in opening cinch bar step (900). In a further embodiment, where the buckle 34 as in FIGS. 4-6 is being utilized, cinch bar 104 may be closed by applying tension to strap 30, 32, which may apply force to cinch bar 104 opposite direction 120, thereby closing cinch bar 104. It is also contemplated that elements of cinch bar 104 and/or living hinges 110, 112 may have sufficient elasticity to close cinch bar 104 by withdrawing whatever pressure was applied to open cinch bar 104, i.e., backward tension may not be required.

Alternatively, a separate force opposite direction 120 may need to be applied to cinch bar 104 in order for tension on strap 30, 32 to engage portions 106, 108 and apply force to cinch bar 104 so as to close it. Such force may be applied by a finger of a user, for instance, or may be applied by suitable articles, such as a common pen or a custom designed article adapted for use with buckle 34.

Thus, embodiments of the controller for a buckle and a respirator using such a buckle, having a flexural member are disclosed. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A buckle, comprising:

a body having a slot; and a cinch bar configured with respect to the slot, the cinch bar having a first position supporting a strap placed thereon and a second position providing an opening sufficient to pass the strap therethrough;

wherein the cinch bar comprises a first member and a second member, and wherein the first member and the second member provide the opening between distal ends of the first member and the second member, the opening being sufficiently large to allow the strap to pass the strap therethrough, the cinch bar returning to the first position and supporting the strap when tension is placed on the strap.

2. The buckle as in claim 1 wherein said first member and said second member are configured to return to said first position in response to a force from said strap when tension is placed thereon.

3. The buckle as in claim 1, wherein said first member and said second member are configured to move to said second position to create said opening allowing said strap to pass therethrough in a first direction in response to a force against said cinch bar from said first direction.

4. The buckle as in claim 3 wherein said buckle is configured such that said first member and said second member move from said first position to said second position in said first direction and wherein said buckle is configured such that said first member and said second member are prevented from moving from said first position in a direction opposite of said first direction.

5. The buckle as in claim 4 wherein said first member and said second member are configured to move to said second position to create said opening allowing said strap to pass therethrough in a first direction in response to a force against said cinch bar from said first direction.

6. The buckle as in claim 4 wherein said first member and said second member abut in said first position.

7. The buckle as in claim 6 wherein said buckle has a major plane, wherein said first direction is substantially orthogonal to said major plane and wherein said first member and said second member in said first position abut at an oblique angle to said major plane.

8. The buckle as in claim 4 wherein said first member and said second member interlock in said first position.

9. The buckle as in claim 1, further comprising a first living hinge coupled between said first member and said body, and a second living hinge coupled between said second member and said body.

10. The buckle as in claim 9 wherein said first living hinge is configured with respect to said first member and said second living hinge is configured with respect to said second member such that said first member and said second member move from said first position to said second position in a first direction and wherein said buckle is configured such that said first member and said second member are prevented from moving from said first position in a direction opposite of said first direction.

11. The buckle as in claim 10 wherein said first member and said second member are configured to move to said second position to create said opening allowing said strap to pass therethrough in said first direction in response to a force against said cinch bar from said first direction.

12. The buckle as in claim 1 wherein said cinch bar is flexibly affixed with said body at one side of said cinch bar.

13. A respirator, comprising:

a mask;

a strap; and a buckle, comprising a body having a slot, the body being attached to the mask; and a cinch bar configured with respect to the slot, the cinch bar having a first position supporting the strap placed thereon and a second position providing an opening sufficient to pass the strap therethrough;

wherein the cinch bar comprises a first member and a second member, and wherein the first member and the second member provide the opening between distal ends of the first member and the second member, the opening being sufficiently large to allow the strap to pass the strap therethrough, the cinch bar returning to the first position and supporting the strap when tension is placed on the strap.

14. The respirator as in claim 13, wherein said first member and said second member are configured to return to said first position in response to a force from said strap when tension is placed thereon.

15. The respirator as in claim 14 wherein said first member and said second member are configured to move to said second position to create said opening allowing said strap to pass therethrough in a first direction in response to a force against said cinch bar from said first direction.

16. The respirator as in claim 15 wherein said buckle is configured such that said first member and said second member move from said first position to said second position in said first direction and wherein said buckle is configured such that said first member and said second member are prevented from moving from said first position in a direction opposite of said first direction.

17. The respirator as in claim 16 wherein said first member and said second member abut in said first position.

18. The respirator as in claim 16 wherein said buckle has a major plane, wherein said first direction is substantially orthogonal to said major plane and wherein said first member and said second member in said first position abut at an oblique angle to said major plane.

19. The respirator as in claim 16 wherein said first member and said second member interlock in said first position.

20. The respirator as in claim 13, further comprising a first living hinge coupled between said first member and said body, and a second living hinge coupled between said second member and said body.

21. The respirator as in claim 20 wherein said first member and said second member are configured to move to said second position to create said opening allowing said strap to pass therethrough in a first direction in response to a force against said cinch bar from said first direction.

22. The respirator as in claim 21 wherein said first living hinge is configured with respect to said first member and said second living hinge is configured with respect to said second member such that said first member and said second member move from said first position to said second position in a first direction and wherein said buckle is configured such that said first member and said second member are prevented from moving from said first position in a direction opposite of said first direction.

23. The respirator as in claim 13 wherein said cinch bar is flexibly affixed with said body at least one side of said cinch bar.

24. A method for securing a strap to a buckle having a slot and a cinch bar configured with respect to the slot, the cinch bar having a first position supporting a strap placed thereon and a second position providing an opening sufficient to pass the strap therethrough, the method comprising:

moving the cinch bar to the second position;

placing a portion of the strap through the opening; and returning the cinch bar to the first position, wherein the cinch bar comprises a first member and a second member, and wherein the first member and the second member provide the opening between distal ends of the first member and the second member, the opening being sufficiently large to allow the strap to pass the strap therethrough, the cinch bar returning to the first position and supporting the strap when tension is placed on the strap.

25. The method as in claim 24 wherein said returning step occurs because tension is placed on said strap.

26. The method as in claim 24, wherein said first member and said second move to said second position to create said opening allowing said strap to pass therethrough in a first direction in response to a force against said cinch bar from said first direction.

27. The method as in claim 26 wherein said first member and said second member move from said first position to said second position in said first direction and wherein said buckle said first member and said second member are prevented from moving from said first position in a direction opposite of said first direction.

28. The method as in claim 27 wherein said first member and said second member abut in said first position.

29. The method as in claim 28 wherein said buckle has a major plane, wherein said first direction is substantially orthogonal to said major plane and wherein said first member and said second member in said first position abut at an oblique angle to said major plane.

30. The method as in claim 24, further comprising a first living hinge coupled between said first member and said body, and a second living hinge coupled between said second member and said body.

31. The method as in claim 30 wherein said first member and said second member move to said second position to create said opening allowing said strap to pass therethrough in a first direction in response to a force against said cinch bar from said first direction.

32. The method as in claim 31 wherein said first member and said second member move from said first position to said second position in a first direction and wherein said first member and said second member are prevented from moving from said first position in a direction opposite of said first direction.

33. The method as in claim 32 wherein said first member and said second member are configured to move to said second position to create said opening allowing said strap to pass therethrough in said first direction in response to a force against said cinch bar from said first direction.

34. The method as in claim 27 wherein said returning step further comprises interlocking said first member and said second member.

* * * * *

UNITED STATES PATENT AND TRADEMARK OFFICE

CERTIFICATE OF CORRECTION

PATENT NO. : 8,375,951 B2
APPLICATION NO. : 12/026874
DATED : February 19, 2013
INVENTOR(S) : Yonas Gebrewold et al.

It is certified that error appears in the above-identified patent and that said Letters Patent is hereby corrected as shown below:

In the Claims:

Column 14
Line 48, in Claim 23, after "body" insert -- at --.

Column 15
Line 2, in Claim 26, after "second" insert -- member --.

Signed and Sealed this
Twenty-eighth Day of May, 2013

Teresa Stanek Rea
*Acting Director of the United States Patent and Trademark Office*